US012560080B2

(12) United States Patent
Roveri et al.

(10) Patent No.: US 12,560,080 B2
(45) Date of Patent: Feb. 24, 2026

(54) UMBILICAL PROTECTION AND STRUCTURAL REINFORCEMENT JOINT FOR COMPLETION AND WORKOVER RISER

(71) Applicant: PETRÓLEO BRASILEIRO S.A.—PETROBRAS, Rio de Janeiro (BR)

(72) Inventors: Francisco Edward Roveri, Rio de Janeiro (BR); Vinicius Sales Rocha, Macaé (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 18/644,493

(22) Filed: Apr. 24, 2024

(65) Prior Publication Data

US 2024/0410268 A1 Dec. 12, 2024

(30) Foreign Application Priority Data

Jun. 6, 2023 (BR) ..... 1020230111475

(51) Int. Cl.
*E21B 47/01* (2012.01)
*E21B 17/01* (2006.01)

(52) U.S. Cl.
CPC ..... *E21B 47/01* (2013.01); *E21B 17/01* (2013.01)

(58) Field of Classification Search
CPC ..... E21B 17/01; E21B 17/02; E21B 17/023; E21B 47/01; E21B 17/1035
See application file for complete search history.

(56) References Cited

U.S. PATENT DOCUMENTS

| | | | | |
|---|---|---|---|---|
| 2,829,190 | A * | 4/1958 | Comlossy, Jr. ..... | H02G 9/06 174/136 |
| 4,004,326 | A | 1/1977 | Beavers | |
| 5,973,270 | A * | 10/1999 | Keller ..... | E21B 17/1035 174/136 |
| 8,752,633 | B2 | 6/2014 | Whitelaw et al. | |
| 11,555,358 | B1 | 1/2023 | Mason et al. | |
| 12,158,049 | B1 * | 12/2024 | Mason ..... | E21B 17/01 |
| 2011/0042095 | A1 * | 2/2011 | Sessions ..... | E21B 17/0853 166/360 |
| 2011/0154620 | A1 | 6/2011 | Whitelaw et al. | |
| 2016/0237758 | A1 * | 8/2016 | Whitefield ..... | E21B 17/1035 |

FOREIGN PATENT DOCUMENTS

GB 2377717 A 8/2005

* cited by examiner

*Primary Examiner* — Caroline N Butcher
(74) *Attorney, Agent, or Firm* — Troutman Pepper Locke LLP

(57) ABSTRACT

The disclosed technology includes an assembly of umbilical protection and structural reinforcement of the completion and workover riser (CWOR), which comprises: a protection and reinforcement joint inserted into the tally of a CWOR, and at least one pair of stiffeners joined at the same height in the longitudinal direction to the outer wall of the CWOR.

13 Claims, 6 Drawing Sheets

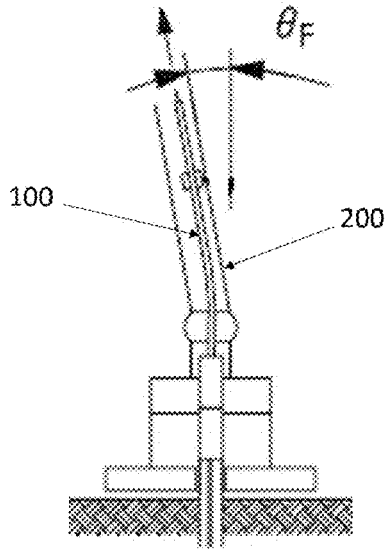
FIG. 1A
(PRIOR ART)
FIG. 1B
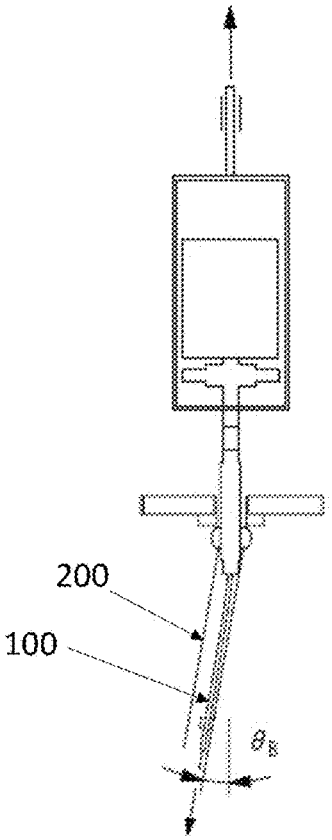
(PRIOR ART)

UMBILICAL PROTECTION AND STRUCTURAL REINFORCEMENT JOINT FOR COMPLETION AND WORKOVER RISER

CROSS-REFERENCE TO RELATED APPLICATION

The application claims, under 35 U.S.C. § 119(a), priority to and the benefit of Brazilian Patent Application No. BR 10 2023 011147 5, filed Jun. 6, 2023, which is incorporated by reference herein in its entirety.

FIELD OF THE INVENTION

The present invention is applied in the field of completion and workover in subsea oil wells and, more specifically, refers to a protection assembly for umbilicals and structural reinforcement for completion and workover risers arranged inside a drilling riser.

BACKGROUNDS OF THE INVENTION

Among the operations necessary for a subsea well to go into production is Completion, which includes the installation of a Production String (PS) inside the well, from the oil reservoir to the wellhead located on the subsea bed, where a Production Adapter Base (PAB) is installed. The equipment that anchors the PS to the PAB is the production string hanger (Tubing Hanger-TH).

In order to install the Production String (PS) inside the well, an assembly of interconnected pipes or joints is used, with each joint having an approximate length of 13 meters, the assembly being called a completion and workover riser (Completion and Workover Riser-CWOR). The CWOR descends internally through the drilling riser, from a rig located on the sea surface to the TH settlement in the PAB. In this phase of the operation, called "TH Mode", the CWOR is protected from the direct action of currents and waves, as it remains inside the drilling riser.

In parallel to the CWOR, an Electro-Hydraulic Umbilical (EHU), with an external diameter smaller than the CWOR, is also lowered inside the drilling riser, internally having a set of electrical and hydraulic lines that will monitor the signals from pressure and temperature sensors during the descent of the PS, as well as maintaining the locks of the installation tools. Once the TH is positioned in its housing inside the PAB, the EHU is used to lock the same and allow fluid circulation into the PS. The EHU is secured to the CWOR using clamps, installed approximately every 13 meters.

To carry out the next phase, which is the descent of the Wet Christmas Tree (WCT) to the seabed, the CWOR and the drilling riser are removed and, after removing both, the CWOR is used again to descend the WCT, now in the open sea, as it would not be possible to descend through the drilling riser due to the lateral dimensions of the equipment. This phase of the operation is called "Open Sea Mode".

Furthermore, it should be noted that in "TH Mode" the most critical axial load occurs, which occurs when the TH is already seated. At this point, a locking test is performed to check whether the connection was effective. The tension applied in the test must be equivalent to the sum of the CWOR own weight and the weight of the PS, also adding the test tension (overpull) and the longitudinal tension (drag) originating from the frictions of the CWOR with the drilling riser and of the PS with the well casing. A dynamic portion of tension due to the vertical acceleration transmitted to the string by the rig support system must also be included.

Thus, in TH Mode, the tension acting on the CWOR combined with the angular displacement of the drilling riser in the lower and upper flexible joints (this is also called diverter flex joint) results in a lateral contact of these components with the CWOR. It is worth highlighting that flex joints are equipment that allows the relative angular movement of the drilling riser, reducing stresses in the riser itself due to the movement of the rig and environmental loads.

The force originating from the lateral contact combined with the tension generates a bending moment of significant value. Therefore, to verify the compliance with the acceptance criteria, the tension and the bending moment must be considered together when determining the acting stresses (combined Von Mises stress) in the CWOR.

Furthermore, the combined stress of tension and flexion is more critical in the region of the diverter flex joint (upper flex joint), because the tension at the upper end is greater. During the TH locking test, the internal pressure acting on the tube is only the hydrostatic pressure.

To exemplarily illustrate the previously-described situations, FIGS. 1A and 1B show the angular displacement $\theta_F$ that occurs in the lower flex joint located on the seabed (FIG. 1A) and the angular displacement $\theta_B$ in the upper flex joint located at the top (FIG. 1B). In both FIGS. 1A and 1B, it is possible to observe a CWOR 100 passing internally to a drilling riser 200. FIG. 1C shows an example of a bending moment diagram acting on the CWOR in the region of contact between the same and the upper flex joint (most critical region).

Due to this complex geometry in the diverter flex joint, with a constant change in direction of the drilling riser in relation to the CWOR, it is necessary to protect the most fragile element of this system, which is the EHU, as well as the CWOR. The large number of damages caused to the EHU in this region is a known fact. To solve the problem associated with the above-mentioned causes, there are several ways to protect the umbilical that descends together with the CWOR. For example, modules made of polymeric material can be installed with cutouts and holes through which the umbilical passes. These modules are assembled when the CWOR joint is vertical, requiring work at height (Man Riding operation, which uses special equipment and poses substantial risk to the operator). The polymeric material modules that protect the EHU form a structure called Cased Wear Joint (CWJ).

However, some problems associated with this type of solution concern the risk of working at height and the time associated with carrying the same out. In addition, due to the high lateral contact forces between the CWJ and the drilling riser in the region of the upper flex joint, and considering the cutouts in the geometry of the CWJ cross section required for the assembly of the EHU, the polymeric material may be subject to stresses above the permissible values, which could damage the CWJ itself and the umbilical and cause fragments to fall into the well, which could cause major problems. Furthermore, the CWOR standard joint used in this position may be subject to combined tensile and flexural stresses greater than the allowable values to meet the acceptance criteria.

Another solution theoretically foreseen in the State of the Art would be to move the rig horizontally so that the angle of the upper flex joint is zero during the entire operation. In practice, this does not occur because the environmental action is not due exclusively to the current, and, therefore, the angle is not static. As waves and wind are always present, the angle of the upper flex joint has dynamic behavior, and changing the rig offset will not be effective. Furthermore, in general, the angles of the lower and upper flex joints behave differently, making it not possible to obtain simultaneous minimum values for both parameters.

Therefore, in view of the problems and listed limitations, there is a need to develop a solution to protect the assembly formed by the completion and workover riser (CWOR) and the umbilical adjacent to the same, within a drilling riser, that reduces or avoids the lateral contact of the umbilical with rig structures in the region below the rotary table and with the internal surface of the drilling riser, in addition to increasing the flexural rigidity and load capacity of the CWOR joint to resist bending stress which will inevitably occur, in operations in the "TH Mode", taking into account the tensile and flexural stresses, as well as the maritime conditions and the angles in the upper and lower flex joints.

STATE OF THE ART

The search for history led to some documents that disclose matters within the technological field of the present invention.

Document U.S. Pat. No. 11,555,358B1 describes a protective member that at least partially surrounds a desired length of pipe and protects the "umbilical" control line(s) or bundles, including pipe and umbilical line(s) installed inside risers of subsea installations. At least one robust protective casing member is installed around at least a portion of a pipe string and forms at least one elongated channel. At least one umbilical control line is disposed within the elongated channel and is protected from damage caused by inadvertent or unwanted abrasion, impact, or other forces. However, in the aforementioned document, the umbilical protection structure, in addition to presenting empty spaces (less resistance to lateral contact with the rotary table), consists of dozens of components that have to be assembled on the main pipe using screws and torque control. Additionally, the assembly of the umbilical protection structure in this document is complex, in addition to working at height on the rig (longer assembly time). Furthermore, the split components in the document are installed after fastening the umbilical to the main pipe.

Document U.S. Pat. No. 4,004,326A describes a protector for protecting the cable that is connected to a piping string in a well. The protector is generally cylindrical, with a hole adapted to be attached to the string, and is constructed in two pieces to facilitate installation. A longitudinally extending slot is provided and it is sized to fully receive the cable. Protectors are spaced along the piping string, which can extend large distances. The protectors may be of elastomeric material and may be eccentric with the cable receiving slot positioned in the thickest section. Lips overlapping the slot may be provided as a measure to secure the cable in the slot, to further protect the cable from burrs or other protuberances, and to provide wear points on the protector further away from the cable. However, this document presents an umbilical protector that is a split piece and may be made of elastomeric material, which may subject the component to combined tensile and flexural stresses greater than allowable values, in addition to adding some complexity to its assembly.

Document U.S. Pat. No. 8,752,633B2 discloses a protective device for protecting at least one cable during the operation of a diverter. The protective apparatus comprises at least one protective assembly formed substantially from a plastic material. The protective assembly defines a plurality of holes, a first hole of the plurality of holes being configured to receive a string and a second hole of the plurality of holes being configured to receive a cable. The protective assembly is further configured to define an outer surface with which an operating diverter engages, when the protective apparatus is in use, and a string is received in the first orifice. However, in said document the umbilical protectors are split pieces, and the umbilical is completely encapsulated.

Document GB2377717A describes a polymeric cable protector that has a cylindrical body formed by two portions that are articulated together. The inner surface of the protector has a number of channels through which cables can pass. The outer surface includes a series of ribs and flutes that may run longitudinally or in a spiral way. The body is tapered near its ends. A second embodiment of the document is in the form of two end caps connected by steel rods. A third embodiment presents a corrugated body to allow it to expand and therefore be used with expandable tubing. However, the umbilical protector is a split piece, with the umbilical being completely encapsulated.

Finally, document US20110154620A1 refers to an apparatus for retaining at least one umbilical in relation to a string. The apparatus comprises a body, first and second members, and first and second fasteners. The body and the first member are movable relative to each other between a first arrangement, in which the body and the first member define a first hole between the same to accommodate a string, and a second arrangement, in which the body and the first member are spaced apart, so that the string can be received or removed from the first hole. However, this document also presents disadvantages, such as that the umbilical protectors are split pieces and the umbilical is completely encapsulated.

BRIEF DESCRIPTION OF THE INVENTION

The present invention is applied in the field of completion and workover of subsea oil wells. More particularly, the present invention relates to a protection assembly for umbilicals and structural reinforcement for completion and workover risers arranged inside a drilling riser.

One of the objectives of the present invention is to avoid the lateral contact of the umbilical with rig structures in the region below the rotary table and with the internal surface of the drilling riser.

In addition, it is also an objective of the present invention to increase the flexural stiffness and load capacity of the joint, to resist the bending stress that will inevitably occur during the lateral contact of the CWOR with the upper flex joint (diverter flex joint).

Furthermore, the present invention also aims at facilitating the fastening of the umbilical to the CWOR during operation in the "TH Mode", allowing work to be done at the level of the rotary table, thus avoiding activity at height and its associated risks.

Using the protective joint for the umbilical and reinforcement for the CWOR of the present invention, it is possible to manufacture the structural components in a simple way (CWOR+Welded Stiffeners). And, in the same way, the protection of the EHU would be carried out in a simple way through the use of a fastening strap being installed during the operation to laterally contain the umbilical. Thus, there is avoided the need for split components or multiple components that require complex assembly and installation.

Furthermore, the umbilical protection assembly of the present invention features stiffeners or steel fins welded to the CWOR during manufacturing (single component "CWOR protection joint+welded fins", which is assembled as a standard joint), providing greater resistance to the lateral contact with the rig.

The present invention uses a smaller number of elements, and those components that could eventually come loose (belt and belt fasteners) are manufactured in a polymer with a lower density than the completion fluid, so that they float. This prevents them from falling into the well.

Accordingly, the advantages and objectives of the present invention are achieved by providing a EHU protection and reinforcement assembly for CWOR, which comprises: a protection and reinforcement joint arranged along a CWOR section, and at least a pair of stiffeners formed by two stiffeners arranged at the same height in relation to the longitudinal direction of the CWOR. The use of the reinforcement joint at the point of the string that suffers the greatest combined stresses eliminates the use of higher stiffness tubes for all PS positions.

BRIEF DESCRIPTION OF THE FIGURES

The previous brief description, as well as the detailed description below of the preferred embodiments of the invention in question, will be better understood when read together with the attached drawings. It must be understood, however, that the invention in question is not limited only to the precise arrangements and instruments as shown.

Therefore, the present invention will be described below with reference to its typical embodiments and also with reference to the attached drawings, in which:

FIG. 1A shows a schematic view of a lower flex joint and well safety equipment at the base of a CWOR (seabed region).

FIG. 1B shows a schematic view of an upper flex joint, surface equipment, and rotary table, from the top of a CWOR (drill floor region).

DETAILED DESCRIPTION OF THE INVENTION

In the following, reference is made in detail to the preferred embodiments of the present invention illustrated in the attached drawings. Whenever possible, the same or similar reference numbers will be used throughout the drawings to refer to the same or similar features. It should be noted that the drawings are in simplified form and are not represented to a precise scale, so slight variations are anticipated.

The present invention refers to an umbilical protection and structural reinforcement joint for a completion riser and workover in the region of the upper flex joint (diverter joint), in well completion operations in the TH mode.

Figure 1C:
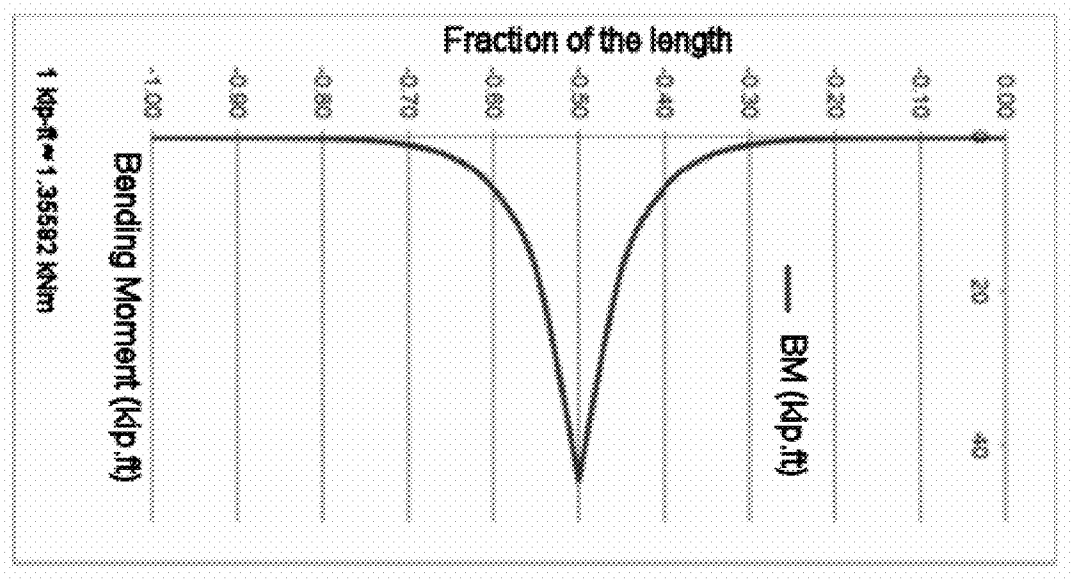
FIG. 1C (PRIOR ART)
FIG. 1C shows an example of a bending moment diagram acting on the CWOR in the region of contact between the same and the upper flex joint (critical region).
Figure 2:
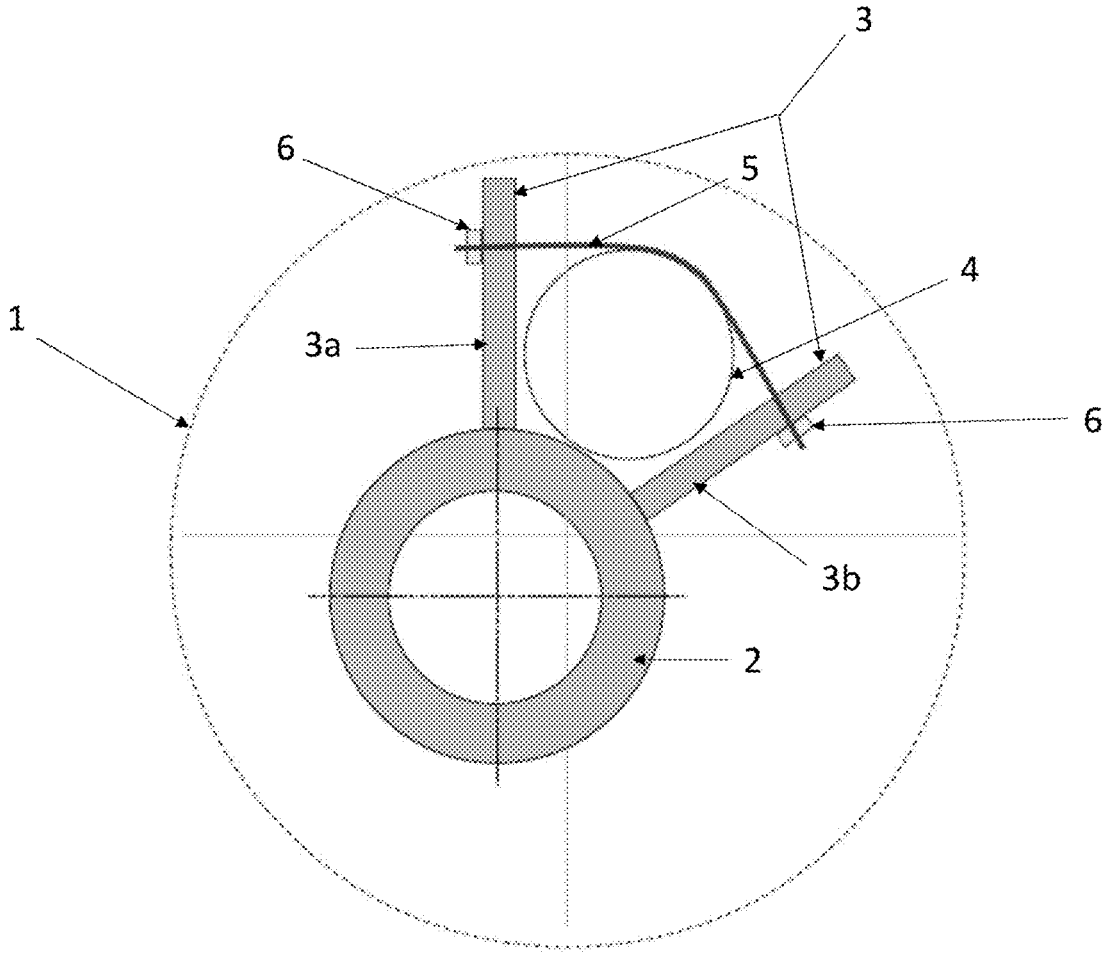
FIG. 2 shows a cross-section of a schematic view of the protection and reinforcement joint, umbilical, and drilling riser, according to an embodiment of the present invention.
Figure 3:
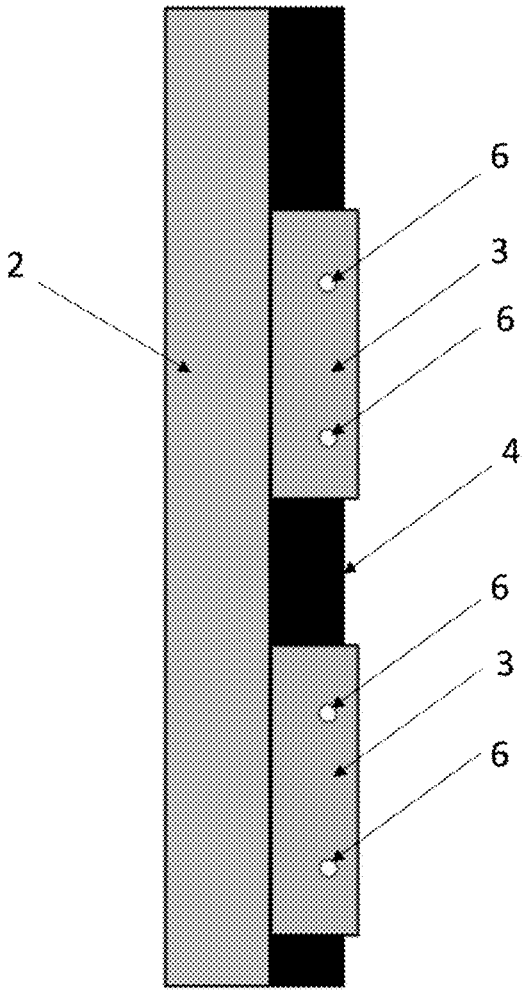
FIG. 3 shows a schematic side view of the protection and reinforcement joint, umbilical and pairs of stiffeners, according to an embodiment of the present invention.
Figure 4:
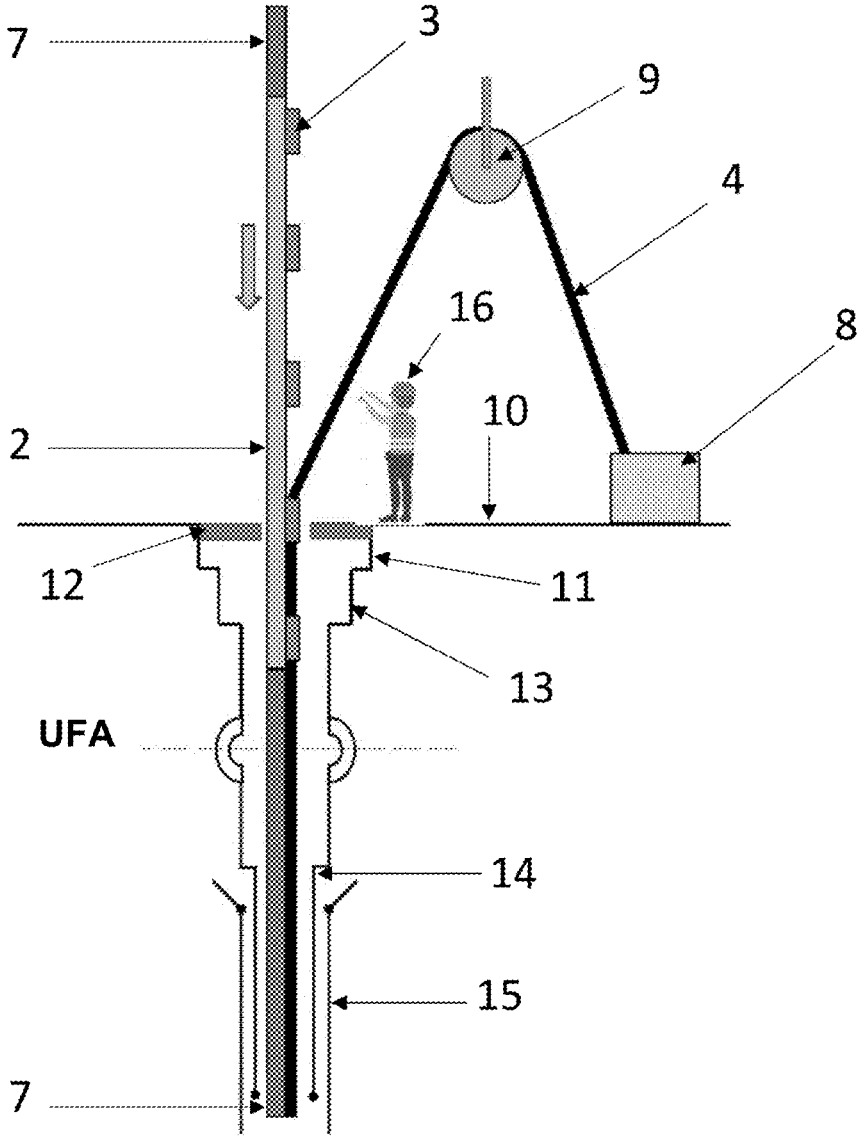
FIG. 4 shows a schematic view of a system configuration at the time of positioning the umbilical in the protection and reinforcement joint, when the TH is close to the seating position in the PAB, according to an embodiment of the present invention.
Figure 5:
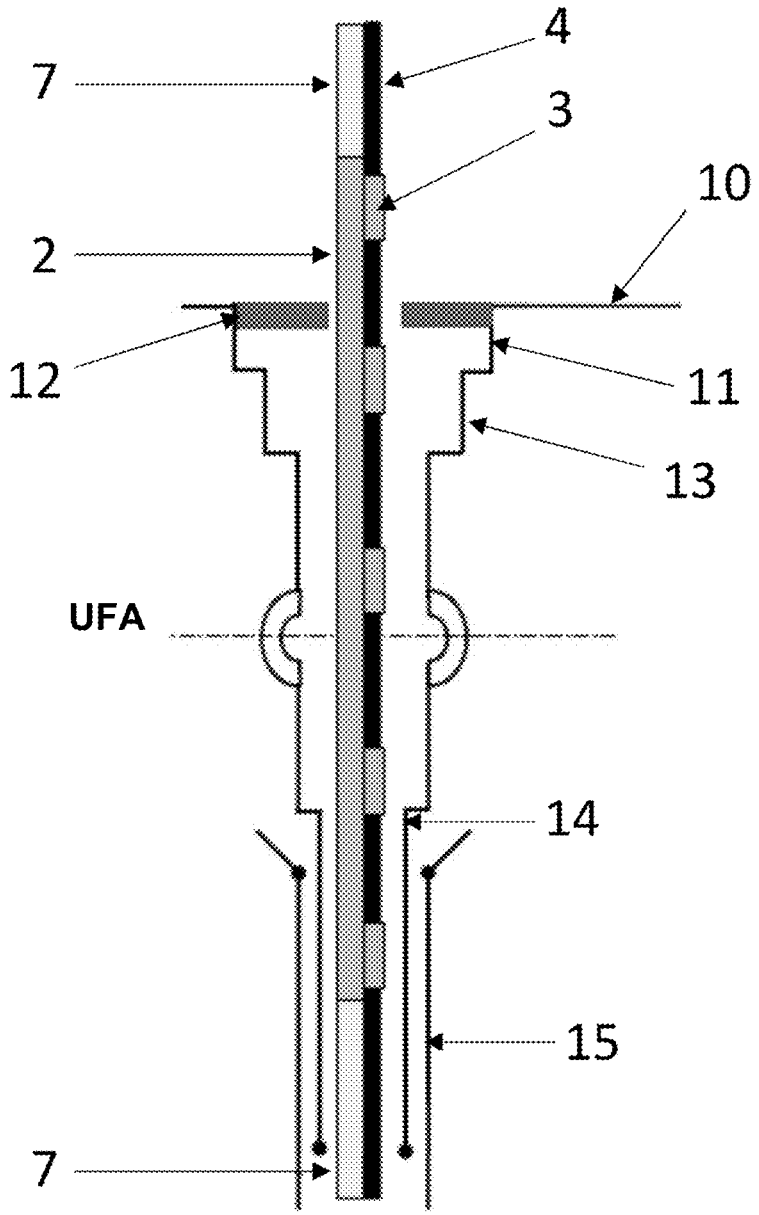
FIG. 5 shows a schematic view of a system configuration after seating the TH and during the TH locking test, according to an embodiment of the present invention.

Reference is made to FIGS. 2 and 3, which present, respectively, a cross-section and a side view of the protection and reinforcement joint for completion and workover riser, with its main components inside a drilling riser 1, according to an embodiment of the present invention. Thus, the assembly comprises a protection and reinforcing joint 2, and at least one pair of stiffeners 3 (or fins) formed by two stiffeners 3*a*, 3*b*, arranged at approximately the same height in relation to the longitudinal direction of the CWOR, wherein each stiffener 3*a*, 3*b* of the pair of stiffeners 3 is joined to a region of the outer wall of the protection and reinforcing joint 2 and spaced angularly with respect to each other, so that at least one pair of stiffeners 3 forms a "V" channel for the passage of an umbilical 4. According to an embodiment of the present invention, each stiffener 3*a*, 3*b* has a general sheet shape and is joined to a region of the outer wall of the protection and reinforcement joint 2 by means of welding. Furthermore, the stiffeners 3*a*, 3*b* are welded to the protection and reinforcement joint 2 during its manufacture, and the protection and reinforcement joint 2 is mounted on the riser tally as a standard joint; that is, the CWOR joint set is composed of at least one protection and reinforcement joint 2 mounted in the region of greatest acting bending moment, between standard CWOR joint sections 7, as shown in FIGS. 4 and 5.

Furthermore, according to an embodiment of the present invention, the protection and reinforcement assembly further comprises at least one fastening strap 5 to contain lateral movements of the umbilical 4, not being required to generate vertical friction force to support the umbilical 4, and attach the umbilical 4 to the outer wall of the protection and reinforcement joint 2 in the space between the two stiffeners 3*a*, 3*b* of at least one pair of stiffeners 3 that form a "V" channel. In addition, as shown in FIG. 2, each end of the fastening strap 5 passes through a fastening system, being secured to the wall opposite the wall facing the "V" channel of each stiffener 3*a*, 3*b* by means of fasteners 6. It should be highlighted that, in some embodiments of the present invention, one or more fastening straps 5 can be used for each pair of stiffeners 3, and one or more fastening systems on each stiffener 3*a*, 3*b* of the pair of stiffeners 3 can be used to secure each fastening strap 5.

In one embodiment of the present invention, both the protection and reinforcement joint 2 of the CWOR and the stiffeners 3*a*, 3*b* joined to the same are made of steel to provide greater strength and properly protect the CWOR and also the umbilical 4 that passes through the "V" channel between the two stiffeners 3*a*, 3*b* of at least one pair of stiffeners 3.

The geometric configuration of the cross section of the assembly, shown in FIG. 2, highlights that the contact with the internal steel wall of the drilling riser 1 can only occur through joint 2 of the CWOR and through the stiffeners 3*a*, 3*b*, avoiding the contact of the umbilical 4 with any adjacent structure that could damage the same. This is possible due to the shape and dimensions of the sheets of the stiffeners 3*a*, 3*b*, which are greater in height than the diameter of the umbilical 4 passing through the "V" channel, and the use of the fastening straps 5 to contain lateral movements of the umbilical 4, so that the contact with the inner wall of the drilling riser 1 will be made by the stiffeners 3*a*, 3*b*, instead of by the umbilical 4.

Additionally, the cross-section of the protection and reinforcement joint 2 has a moment of inertia greater than the moment of inertia of the standard joint 7, providing greater flexural resistance capacity to the assembly.

It should also be highlighted that the use of the protection and reinforcement joint 2 in the region with the highest acting bending moment results in the other sections formed by the standard joints 7 along the CWOR being subjected to a lower bending load and, consequently, they will have greater tension capacity.

Furthermore, as shown in FIGS. 3, 4 and 5, the protection and reinforcement joint 2 of the CWOR comprises one or more pairs of stiffeners 3 joined to the same, distributed at regular or irregular intervals between a pair of stiffeners 3 and the its adjacent pair 3 along the longitudinal direction of the joint 2, wherein the number of pairs 3 and the intervals between pairs 3 are determined according to the design and application needs.

Additionally, in an alternative embodiment of the present invention, at the same height of the protection and reinforcement joint 2, more than one pair of stiffeners 3 are provided around the outer wall of the joint 2, in case there are more than an umbilical 4 to be lowered towards the well.

FIG. 4 shows a configuration of the present invention, when the TH is close to the seating position on the PAB, and the umbilical 4 is connected to the protection and reinforcement joint 2 of the CWOR. In this configuration, the umbilical 4 is supplied through a spool 8 arranged on the drill floor 10 and passes through a pulley 9, being positioned in the "V" channel of at least one pair of stiffeners 3 and connected to the joint of protection and reinforcement 2 by the fastening strap 5. The positioning and connection of the umbilical 4 are carried out by an operator 16 located on the drill floor 10, close to a rotary table 11 where the CWOR passes, without the need for working at height. Furthermore, it should be highlighted that the "V" channel of the cross section defined by the pair of stiffeners 3 facilitates the positioning of the umbilical 4 and the installation of the fastening strap 5.

FIG. 5 shows a time subsequent to that portrayed by FIG. 4, that is, after seating the TH in the PAB and during the TH locking test. In the configuration presented in FIG. 5, the protection and reinforcement assembly containing the protection and reinforcement joint 2 and the pairs of stiffeners 3 has a portion that passes through the rotary table bushing 12 (master bushing) and diverter housing 13 until reaching the upper flex joint axis UFA passing then through the telescopic joint internal barrel 14 disposed internally to the telescopic joint 15 of the drilling riser. In this configuration, it is highlighted that the umbilical 4 remains protected, within the "V" channels formed by the pairs of stiffeners 3 and connected to the protection and reinforcement joint 2 by means of the fastening straps 5. In this way, the contact of the umbilical 4 with the inner wall of the drilling riser 1 is avoided, even considering the rotations that occur in the upper flex joint in structural analyses or in operation.

Those skilled in the art will value the knowledge presented herein and will be able to reproduce the invention in the presented embodiments and in other variants, encompassed within the scope of the attached claims.

The invention claimed is:

1. An assembly for Electro-Hydraulic Umbilical (EHU) protection and structural reinforcement for a Completion and Workover Riser (CWOR), comprises:

a protection and reinforcement joint inserted into a tally of the CWOR;

at least one pair of stiffeners formed by two stiffeners arranged at a same height in relation to a longitudinal direction of the CWOR, wherein each stiffener comprises an outer portion of a wall and an inner portion of the wall, such that the inner portion of the wall defines a portion of a channel; and at least one fastening strap, wherein each end of the at least one fastening strap is configured to pass horizontally through a fastening system and secure to the outer portion of the wall of each stiffener, so that each end is secured approximately parallel to the inner portion of the wall of each stiffener and opposite to the channel.

2. The assembly according to claim 1, wherein each stiffener of the pair of stiffeners is longitudinally joined to an outer wall of the protection and reinforcement joint and spaced angularly with respect to each other, so that the at least one pair of stiffeners forms a "V" channel for a passage of an umbilical.

3. The assembly according to claim 2, wherein the protection and reinforcement joint of the CWOR comprises one or more pairs of stiffeners, distributed continuously along the longitudinal direction of the protection and reinforcement joint.

4. The assembly according to claim 2, wherein at the same height of the protection and reinforcing joint, in relation to a longitudinal direction of the CWOR, more than one pair of stiffeners are provided around the outer wall of the protection and reinforcement joint.

5. The assembly according to claim 2, wherein the umbilical is positioned in the "V" channel of at least one pair of stiffeners and connected to the protection and reinforcement joint by the fastening strap, wherein the positioning and the connection of the umbilical are carried out by an operator located on a drill floor.

6. The assembly according to claim 2, wherein the protection and reinforcement joint of the CWOR comprises one or more pairs of stiffeners, wherein the one or more pairs of stiffeners are spaced evenly along the longitudinal direction of the protection and reinforcement joint relative to an adjacent pair of stiffeners.

7. The assembly according to claim 2, wherein the protection and reinforcement joint of the CWOR comprises one or more pairs of stiffeners, wherein the one or more pairs of stiffeners are spaced unevenly along the longitudinal direction of the protection and reinforcement joint relative to an adjacent pair of stiffeners.

8. The assembly according to claim 1, wherein each stiffener has a general sheet shape and is joined longitudinally to an outer wall of the protection and reinforcement joint by welding.

9. The assembly according to claim 2, wherein the at least one fastening strap is configured to contain lateral movements of the umbilical and secure the umbilical to the outer wall of the protection and reinforcement joint in the space between the two stiffeners of at least one pair of stiffeners that form the "V" channel.

10. The assembly according to claim 1, wherein each end of the at least one fastening strap is configured to be secured to the outer portion of the wall of each stiffener by fasteners.

11. The assembly according to claim 1, wherein both the protection and reinforcement joint of the CWOR and the stiffeners are made of steel.

12. The assembly according to claim 1, wherein the assembly comprises two or more fastening straps attached to the at least one pair of stiffeners.

13. The assembly according to claim 1, wherein the at least one fastening strap comprises a length less than a circumference of the protection and reinforcement joint.

* * * * *